United States Patent [19]

Toia

[11] 4,330,783

[45] May 18, 1982

[54] COAXIALLY FED DIPOLE ANTENNA

[76] Inventor: Michael J. Toia, Box 21, Columbia, Md. 21045

[21] Appl. No.: 96,738

[22] Filed: Nov. 23, 1979

[51] Int. Cl.[3] ..... H01Q 9/16

[52] U.S. Cl. ..... 343/749; 343/792

[58] Field of Search ..... 343/792–796, 343/285, 802–804, 807, 749

[56] References Cited

U.S. PATENT DOCUMENTS

| | | | |
|---|---|---|---|
| 2,313,046 | 3/1943 | Bruce | 343/792 |
| 3,419,872 | 12/1968 | St. Vrain et al. | 343/792 |
| 3,789,416 | 1/1974 | Kuecken et al. | 343/792 |
| 3,818,488 | 6/1974 | Majkrzak et al. | 343/792 |
| 3,961,331 | 6/1976 | Campbell | 343/792 |
| 3,961,332 | 6/1976 | Middlemark | 343/792 |
| 4,180,819 | 12/1979 | Nakano | 343/792 |

*Primary Examiner*—Eli Lieberman

*Attorney, Agent, or Firm*—Morton J. Rosenberg

[57] ABSTRACT

An antenna system which provides an improved RF balancing system for electrically short, coaxially fed antennas. Antenna system (10) includes a first longitudinally extending dipole assembly (11) which has a capacitive inductive voltage induced therein. A second longitudinally extended dipole assembly (13) is axially aligned with the first longitudinally extended dipole assembly (11) and is positionally displaced from the first dipole assembly (11). A mechanism for electrically coupling the first dipole assembly (11) to the second dipole assembly (13) is provided. The capacitive inductive voltage is substantially equalized between the first dipole assembly (11) and the second dipole assembly (13) for voltage balancing the first and second dipole assemblies (11 and 13), each with respect to the other.

9 Claims, 9 Drawing Figures

10
11
12
13
14
16
18
20
22
24
25
26
28
32
34
36
38
39
40
42
44
46
48
50
52
54
56
58
60
62
64
66
68
70
72
3
4
5
6
7
8

FIG. 3
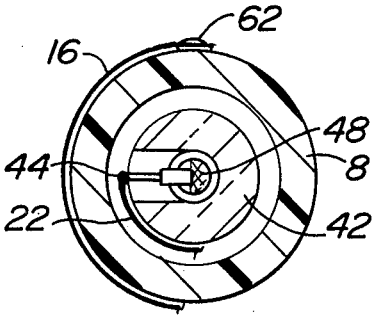
FIG. 4
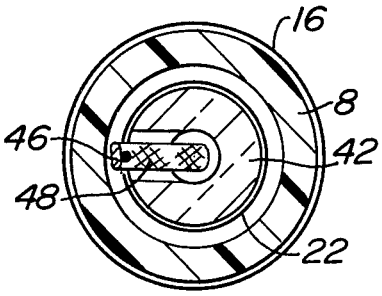
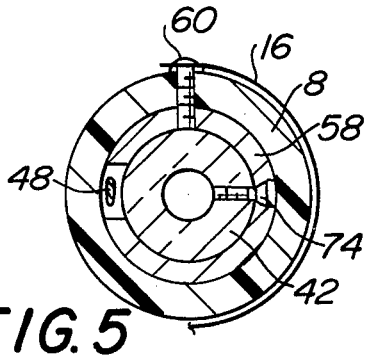
FIG. 5
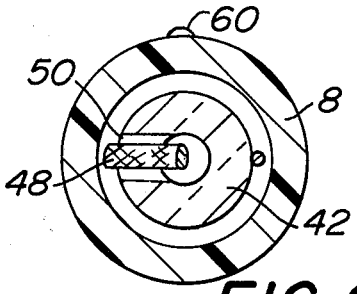
FIG. 6
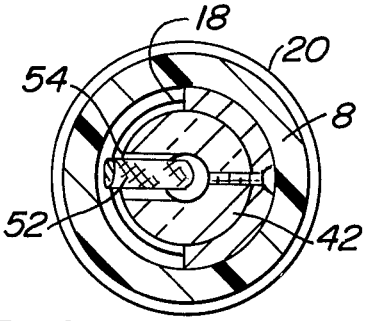
FIG. 7
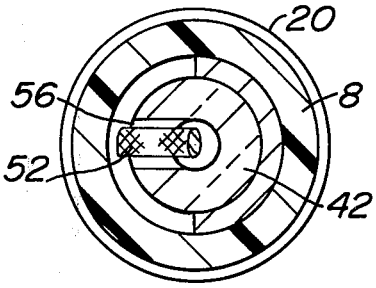
FIG. 8

COAXIALLY FED DIPOLE ANTENNA

BACKGROUND OF THE INVENTION

1. Field of the Invention

This invention pertains to antenna systems. In particular, this invention relates to electrically short and coaxially fed antenna systems. More in particular, this invention pertains to an RF balancing system for electrically short and coaxially fed antenna systems.

2. Prior Art

Coaxially fed antenna systems having a half-wave dipole consisting of two pieces of one-quarter wave tubing which are axially aligned and center fed with coaxial cable is known in the prior art. Additionally, coaxial cable extending through one of the two tubular members is also known in the prior art, such prior art antennas utilizing techniques known in the art as Bazooka balun, which is a quarter wavelength piece of tubing passed over the coaxial cable. Such resonates and generally traps out any radiation over the coaxial cable. However, such prior art antenna systems are generally approximately one-half wavelength in overall extended direction. Such prior art antennas are exceedingly lengthy and do not allow for the utility of a shorter extended length antenna system, as is provided in the inventive concept.

Other prior art antenna systems known to applicant include U.S. Pat. Nos. 3,961,332; 3,735,413; 3,789,416; 3,611,397; 3,932,873; 2,344,171; 2,234,234; and, 2,821,709.

In some prior art systems such as that shown in U.S. Pat. No. 3,789,416, the feed line is introduced at right angles to the radiating element axes. This is in contradistinction to the subject invention concept, wherein the RF balancing is provided for coaxially fed antenna systems. Additionally, in prior U.S. Pat. No. 3,611,397, such systems incorporate feed lines at right angles to the antenna axis, which is substantially removed from the coaxial design of the subject invention concept antenna system. In many prior art systems such as that provided in U.S. Pat. No. 3,932,873, there is no RF compensation and further, such provides for antenna dimensions of a quarter-wavelength or greater which would be in contradistinction to the overall concept of the subject antenna system.

SUMMARY OF THE INVENTION

An antenna system which includes a first longitudinally extended dipole assembly having a capacitive inductive voltage induced therein. The antenna system further includes a second longitudinally extended dipole assembly which is substantially axially aligned with and positionally displaced from the first dipole assembly. A mechanism for electrically coupling the first dipole assembly to the second dipole assembly is provided wherein the capacitive inductive voltage is substantially equalized between the first dipole assembly and the second dipole assembly for voltage balancing the first and second dipole assemblies, each with respect to the other.

BRIEF DESCRIPTION OF THE DRAWINGS

FIG. 3 is a sectional view of the antenna system taken along the section lines 3—3 of FIG. 2;

FIG. 4 is a sectional view of the antenna system taken along the section lines 4—4 of FIG. 2;

FIG. 5 is a sectional view of the antenna system taken along the section lines 5—5 of FIG. 2;

FIG. 6 is a sectional view of the antenna system taken along the section lines 6—6 of FIG. 2;

FIG. 7 is a sectional view of the antenna system taken along the section lines 7—7 of FIG. 2;

FIG. 8 is a sectional view of the antenna system taken along the section lines 8—8 of FIG. 2; and, FIG. 9 is a schematic type electrical diagram, showing the electrical concepts of the subject antenna system.

DESCRIPTION OF THE PREFERRED EMBODIMENTS

Figure 1:
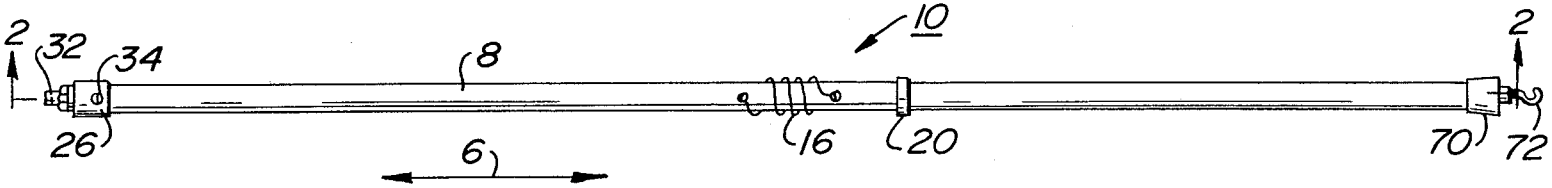
FIG. 1 is a frontal view of the antenna system.

Referring now to FIGS. 1–9, there is shown antenna system 10 defining a short center-fed dipole system, extending in longitudinal direction 6. Antenna system 10, as herein described, has been successfully operated between 1.5–54.0 MHz and has been particularly successfully used within the CB bandwidth range of 26.965 MHz–27.405 MHz, and the amateur bandwidths of 14.000 MHz to 14.350 MHz, 21.000 MHz to 21.450 MHz, and 28.000 to 29.700 MHz. Generally, within the CB bandwidth, half-wave antennas would necessitate extended lengths of approximately 17.5 feet, which would provide a half-wave antenna resonant in the CB band. In opposition, the subject antenna system 10 has an extended length in longitudinal direction 6 approximately 4 feet with an overall external diameter of approximately 1.0 inches. The entire system components of anntenna system 10 is mounted within plastic housing 8 and is then adapted as will be seen in following paragraphs to hang on a wall of a dwelling, from a picture hook, or from a drapery rod or some other like mounting mechanism.

Figure 9:
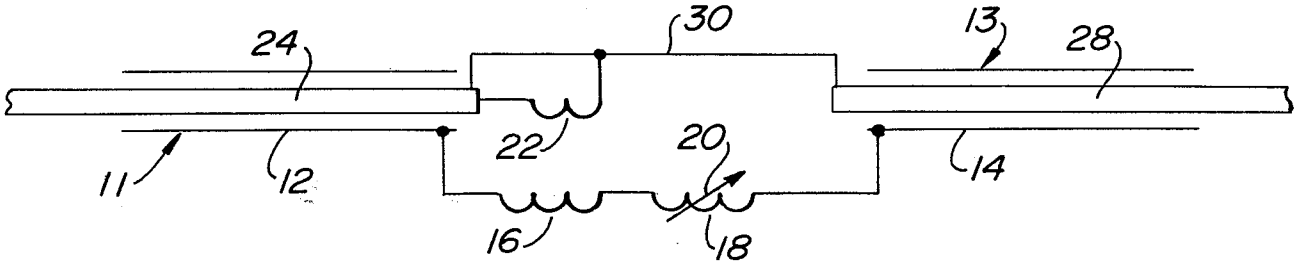

One of the key utilities is to provide antenna system 10 having an extended length in longitudinal direction 6 of less than one-half the wavelength associated with antenna systems resonant in the CB or amateur radio band. System 10 includes first dipole assembly 11 and second dipole assembly 13, as is shown in FIG. 9. The extension length of each of first dipole assemblies 11 and second dipole assembly 13 approximates 2 feet in length thus, each is less than one-quarter wavelength. If the combined dipole assemblies 11 and 13 were a full half-wavelength in their combined extended direction 6, the half of dipole assembly 11 or 13 through which a coaxial cable feed was admitted, would be a quarter-wavelength. This is a standard commercially well-known design commonly known as a quarter-wave Bazooka section that would decouple the coax from the RF fields. However, in such prior designs, half of the extended length of such antennas would approximate a quarter-wavelength, whereas in antenna system 10, as will be shown in following paragraphs, a half-length of the overall extended direction of antenna system 10 is less than a quarter-wavelength. In the common nomenclature of the antenna field of art, antenna system 10 would be referred to as an electrically short (less than one-half wavelength) center-fed dipole system. The overall advantages of antenna system 10 allows the extended dimension in longitudinal direction 6 to be considerably smaller than previously known antenna systems of this general type and the particular decoupling scheme as will be provided allows for frequency independence.

Figure 2:
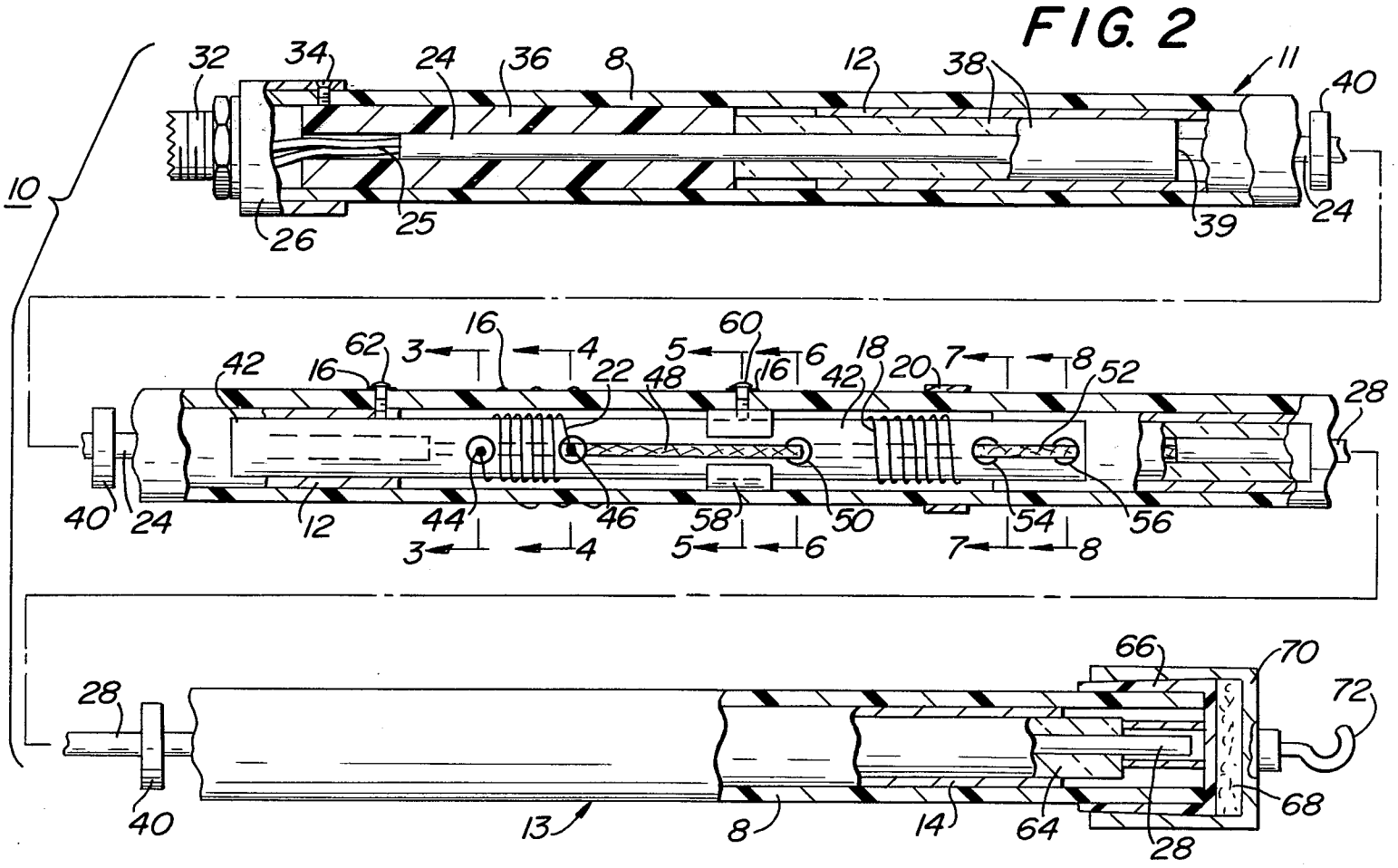
FIG. 2 is a partially cut-away view of the antenna system, showing the internal components and the coupling therebetween.

Referring now to FIGS. 1 and 9, antenna system 10 includes first longitudinally extended dipole assembly 11 having a capacitive inductive voltage induced therein. Additionally, system 10 further comprises second longitudinally extended dipole assembly 13 substantially axially aligned with and positionally displaced from first dipole assembly 11. Both first dipole assembly 11 and second dipole assembly 13 are encased within plastic housing 8 and is shown in FIGS. 1 and 2.

First and second dipole assemblies 11 and 13 include extended and axially aligned respective aluminum tubes 12 and 14 separated by an insulator. Electrically conducting tubes 12 and 14 are electrically coupled each to the other through first and second loading coils 16 and 18. Second loading coil 18 is a generally small loading coil which is variable through shorted ring 20 extending around the external surface of plastic housing 8, as is shown in FIG. 1. Ring 20 is formed of a short piece of aluminum tubing, which is continuous in the circumferential direction.

Link coil 22 injects electrical power into primary or first loading coil 16 in order to excite antenna system 10. Link coil 22 is electrically coupled to coaxial cable 24 which is a standard coaxial cable element, and electrical power is injected through first end cap 26 and coaxial fitting 32, as is shown in FIGS. 1 and 2. Coaxial fitting 32 and first end cap 26 are coupled to a standard coaxial connector assembly (not shown). End cap 26 is a standard metallic cap made of copper and is used to mount the standard coaxial connector fitting 32.

It is important to note that antenna system 10 is coaxially fed, wherein coaxial cable 24 extends through a center passage of tubing element 12, resulting in a coaxially center-fed short dipole antenna system 10. In previous systems, a large RF imbalance would exist due to the coaxial cable coming through one of the tubing members. An important consideration in providing for RF balance in system 10 was to insert electrical conductor element 28 within tube 14 of second dipole assembly 13, as is clearly shown in the schematic diagram of FIG. 9. Conductor element 28 has the overall characteristic that its external diameter is substantially equal to the external diameter of coaxial cable 24 inserted in longitudinal direction 6 within aluminum tube 12. In this manner, an equal amount of capacitive inductive voltage pick-up is provided on conductor element 28, as is provided from one-half of dipole antenna system 10 on first dipole assembly 11, as is generated in coaxial cable 24. In this manner, antenna system 10 is RF balanced. This coupling system in combination with link coil 22, first and second loading coils 16 and 18, provides for a mechanism for electrically coupling first dipole assembly 11 to second dipole assembly 13, in a manner such that the capacitive inductive voltage is substantially equalized between first dipole assembly 11 and second dipole assembly 13 for voltage balancing first and second dipole assemblies 11 and 13, each with respect to the other.

Electrical conducting element 28 is generally independent of the material being used, but must have substantially the same external diameter as coaxial cable 24. As a matter of practicality and convenience, antenna system 10 of the subject inventive concept, provides for conductor element 28 being coaxial cable similar to coaxial cable 24, as previously described. Conductor element 28 is not coupled to other elements, but is merely insertable within aluminum tube 14. Conductor element 28 only includes a connection to one end of the braid of coaxial cable 24 through jumper link 30, as shown in FIG. 9.

Thus, as has previously been described, first dipole assembly 11 includes first tubular dipole element 12 having an extension length less than a quarter-wavelength. Additionally, assembly 11 includes first center conductor element 24 which may be a coaxial cable extending through first tubular dipole element 12 and conductor element 24 has an electrical feed point on a first end thereof, and is coupled to the electrical coupling mechanism on a second end thereof, as is clearly seen in FIG. 9. Further, second dipole assembly 13 is provided with second tubular dipole element 14 having an extension length also less than a quarter-wavelength, similar to that for first tubular dipole element 12. Second center conductor element 28 extends through second tubular dipole element 14, and second center conductor element 28 is electrically decoupled from second tubular dipole element 14 and first tubular dipole element 12, as has been described in previous paragraphs.

Referring now to FIG. 2, there is shown the cutaway sections of antenna system 10 providing for all of the assembly elements contained therein. First end cap 26 is coupled in the standard manner to coaxial connector or fitting 32, that the operator would attach coaxial cable from his/her transmitter/receiver. Coaxial fitting 32 is mechanically fastened to first end cap 26 through a threaded insert not important to the inventive concept of the subject invention. End cap 26 is mounted to plastic housing 8 through mounting screw 34, as is shown. Coaxial cable end 25 through which power is injected into antenna system 10, is prepared in a manner such that the braid portion and center conductor couples to coaxial connector assembly through coaxial fitting 32 in a standard well-known manner. Coaxial cable 24 includes the normal or standard outer plastic covering or housing, with a center conductor and coaxial cable braid.

Coaxial cable 24 extends in longitudinal direction 6 through plastic shim tubing 36, which interfaces with an internal circumferential surface of plastic housing 8 and provides a through opening within which coaxial cable 24 may be inserted. Plastic shim tubing 36 is utilized to hold the various elements contained within housing 8 in fixed constrainment to prevent relative displacement of elements contained therein.

Coaxial cable 24 extends through plastic tubing 38 which is contiguously mounted in aligned manner with plastic shim tubing 36, as is shown. Additionally, plastic tubing 38 is force fit into first dipole tubular element 12. Plastic tubing 38 is provided to maintain coaxial cable 24 in an axially centered position within conductor 12 and to electrically insulate coaxial cable 24 from aluminum tubing 12, as is clearly seen. Coaxial cable 24 may not be positioned near or substantially in the neighborhood of conductor 12 due to the fact that there may be burn-through or arc-over problems with the resulting possibility of a flash being initiated through the insulation of coaxial cable 24 into the coax proper, which would undoubtedly have the effect of the voltage antenna system 10 rising to an unacceptable high degree under transmit conditions.

Plastic tubing 38 extends in axial or longitudinal direction 6 through only a portion of the axial extension of tubing 12. Plastic tubing 38 terminates in end section 39, as is shown. A plurality of plastic disks 40 having a through opening are mounted over coaxial cable 24, as is shown. Each of plastic disks interface with an internal surface of aluminum tubing 12 and are displaced each from the other in axial direction 6. Plastic disks 40 are secured to cable 24 prior to assembly within plastic housing 8 and aluminum tubing 12. Thus, coaxial cable 24 is insulated from aluminum tubing 12 both by plastic disks 40 and by air throughout the extension of coaxial cable 24 within aluminum tubing 12.

The central portion of antenna system 10 is constructed on base or center plastic tubing 42. Coaxial cable 24 passing from coaxial connector 32 is inserted within center plastic tubing 42 and terminates short of link coil 22. As is shown in FIGS. 2 and 3, the central portion of coaxial cable 24 is coupled to link coil 22 at the coupling point 44. As is seen, link coil 22 is helically wound around an external surface of center plastic tubing 42 and is coupled to the central portion of coaxial cable 24 through an opening formed in a sidewall of tubing 42. The braid of coaxial cable 24 is coupled to an opposing end of link coil 22 at coupling point 46, as is shown in FIGS. 2 and 4. Link coil 22 is the mechanism by which power is injected into antenna system 10, and such is wound coaxially in radial alignment with first loading coil 16 helically wound external to plastic housing 8, as is seen in FIGS. 2 and 1. Center braid 48 extends external to plastic tubing 42 and extends in axial direction 6 passing through the opening in tubing 42 provided for coupling point 46. Metal braid 48 may be the braid used for conductor element 28 and as has been previously described, such does not have to be formed of coaxial braid, however, such has been used for commercial economic reasons.

Center metal braid 48 passes through opening 50 internal to center plastic tubing 42 and longitudinally extends under second loading coil 18 within tubing 42. Second loading coil 18, being the adjustment coil for adjusting the center resonant frequency of antenna system 10. Second loading coil 18 is variably adjustable by sliding shorted ring 20 in longitudinal direction 6 and such shorted ring 20 is slidably mounted on an exterior surface of plastic housing 8, as is clearly shown. Such is user or operator adjustable to vary the inductance of second loading coil 18. As shown in FIGS. 2 and 6, center metal braid 48 passes internal to center plastic tubing 42 through opening 50 formed in a lateral sidewall of tubing 42. The metal braid exits tubing 42 through opening 54 passing external to tubing 42 and being defined as external section 52, shown in FIG. 2. External section 52 then passes internal to tubing 42 through opening 56 and joins the main body of coaxial cable 28.

In operation during manufacture, a portion of the insulation of coaxial cable 28 is skinned or removed and the standard center conductor is pulled free. The remaining braid is pulled out and snaked through the openings, as previously described. The interweaving or snaking of the braid of coaxial cable 28 is important in that such braid must not come too close to various other conductors of antenna system 10, or an RF flash problem may arise. Such flash problem may result in minor fires which may cause antenna system 10 to actually burn up and become useless.

External section 52 passing through opening 56 to the center of antenna system 10 becomes the braid of the main body of balancing coaxial cable or conductor 28. Metallic clip 58 which may be an aluminum clip is formed in a one-piece manner of tubing with an opening extending in longitudinal direction 6. The opening provides a passageway for center metal braid 48 to pass therethrough. Clip 58 is provided such that screw 60 can protrude through plastic housing 8 for mounting of first loading coil 16, as is shown. Additionally, screw member 62 is similarly provided to couple first loading coil 16, as is shown in FIG. 2. Note that screw member 62 passes through plastic housing 8 and contiguously contacts aluminum tube 12. Second screw member 60 contacts aluminum clip 58 in a contiguous manner. Aluminum clip 58 provides contact between outer coil or first loading coil 16 and inner adjustment coil or second loading coil 18. As has been stated, both first loading coil 16 and second loading coil 18 are coupled to aluminum clip 58 through the screw mechanism system including screw members 60 and 74 shown in FIG. 5.

Referring to shorted ring member 20, such is formed of a solid aluminum ring providing a sliding fit over plastic housing 8. When ring 20 is moved or displaced on plastic housing 8 in a manner such that it does not overlap second loading coil 18, such is a small loading coil having a predetermined inductance. As shorted ring 20 is displaced in a manner to overlap second loading coil 18, such comes into a range where it constitutes a shorted single turn length that is electrically coupled to second loading coil 18. This causes a decrease in the inductance of second loading coil 18 and such inductance may be varied dependent upon the degree of overlapping relation. Displacement of shorted ring 20 allows antenna system 10 to be user adjustable. Thus, the purpose of shorted ring 20 is to allow second loading coil 18 to become an adjustable coil in order that the operator or user may set the center frequency wherever he or she desires over some predetermined range. The bandwidth of antenna system 10, as described herein, at 14 MHz is generally a usable bandwidth of plus or minus 50 kilohertz without displacement of shorted ring 20. By displacement of shorted ring 20, there has been found that the usable bandwidth has been increased to cover about 700 kilohertz.

Referring now to second dipole assembly 13, there is shown conductor 28 extending in axial direction 6 within aluminum tube 14. Conductor 28 extends within plastic plug 64 which interfaces on an exterior surface with aluminum tube 14 and on an interior surface with conductor 28. Plug 64 insulates conductor 28 and such is adhesively bonded or otherwise fixedly attached to plastic plug 64 in order that conductor 28 is non-movable.

Antenna system 10 second dipole assembly 13 terminates in tube cap member 66 which is a vinyl tube covering adhesively bonded over plastic housing 8 in order to seal out any moisture, dirt or other undesirable particulate matter. Second cap or over cap member 70 formed of a plastic-like composition is force fit over tube cap 66 which has as its purpose to hold or fixedly constrain an electrically non-conductive block 68, which may be a wood plug to serve as an anchor point when a brass cup hook member 72 is inserted therein. Cup hook 72 merely increases the utility of antenna system 10 by allowing such system 10 to be hooked to an external appendage, such as a drapery rod or other like fixture.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. An antenna system comprising:

a first longitudinally extended dipole assembly including a first tubular dipole element, said assembly having a capacitive inductive voltage induced therein, said first dipole assembly including a first center conductor element having an electrical feed point on a first end thereof for introducing electrical power therethrough, said first center conductor element extending throughout said longitudinal extension of said first dipole assembly for exiting at an end section thereof, a second longitudinally extended dipole assembly including a second tubular dipole element, said second dipole assembly substantially axially aligned with and positionally displaced from said first dipole assembly, said second dipole assembly including a second center conductor element contained therein, said second center conductor extending throughout said second longitudinal extension of said second dipole assembly, said second center conductor element being electrically decoupled from said first and second dipole assemblies, said first and second center conductor elements being positionally aligned wherein said inductive voltage in each of said center conductor elements is of substantially equal magnitude and out of phase each with respect to the other, and, means for electrically coupling said first dipole assembly to said second dipole assembly, said capacitive inductive voltage being substantially equalized between said first dipole assembly and said second dipole assembly for voltage balancing said first and second dipole assemblies each with respect to the other, said coupling means including a center link coil assembly coupled to a second end of said first center conductor element and a loading coil assembly coupled to said first and second tubular dipole elements, said loading coil assembly being inductively coupled to said center link coil assembly and including a primary loading coil element coupled to said first tubular element and an adjustable loading coil assembly coupled in series relation to said primary loading coil element and said second tubular dipole element for adjusting said antenna system to a predetermined resonance frequency.

2. The antenna system as recited in claim 1 where said first tubular dipole element has an extension length distinct from a quarter-wavelength, said first center conductor element being coupled to said electrical coupling means on said second end thereof.

3. The antenna system as recited in claim 2 where said second tubular dipole element has an extension length distinct from a quarter-wavelength, said second center conductor element extending through said second tubular dipole element, said second center conductor element being electrically decoupled from said second tubular dipole element and said first tubular dipole element.

4. The antenna system as recited in claim 3 where said first and second center conductor elements have a substantially equal outer diameter for providing substantially equal capacitive inductive voltage insert to said first and second center conductor elements.

5. The antenna system as recited in claim 1 where said adjustable loading coil assembly includes:

(a) a secondary loading coil element coupled in series relation to said primary loading coil element and said second tubular dipole element; and, (b) a continuous electrically conductive annular element slideable in said longitudinal direction over an outer surface of said second tubular dipole element.

6. The antenna system as recited in claim 1 where said first and second center dipole elements are formed of coaxial cable elements.

7. The antenna system as recited in claim 1 including a longitudinally extending housing element extending beyond a combined longitudinal extension length of said first and second tubular dipole elements, said housing element having a first end section and a longitudinally opposed second end section.

8. The antenna system as recited in claim 7 including a first end cap secured to said housing first end section for coupling said first dipole assembly to an external electrical feed line.

9. The antenna system as recited in claim 7 including a second end cap secured to said housing second end section, said second end cap having a hook member for mounting of said antenna system to an external surface.

* * * * *